US008100711B2

(12) United States Patent
Nguyen et al.

(10) Patent No.: US 8,100,711 B2
(45) Date of Patent: Jan. 24, 2012

(54) ALIGNMENT ASSEMBLY FOR ELECTRICAL CONNECTORS

(75) Inventors: Hung Thai Nguyen, Harrisburg, PA (US); Matthew R McAlonis, Elizabethtown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/478,884

(22) Filed: Jun. 5, 2009

(65) Prior Publication Data

US 2010/0311268 A1 Dec. 9, 2010

(51) Int. Cl.
*H01R 13/64* (2006.01)

(52) U.S. Cl. ..... 439/378

(58) Field of Classification Search ..... 439/378, 439/680, 633, 681
See application file for complete search history.

(56) References Cited

U.S. PATENT DOCUMENTS

| | | | | |
|---|---|---|---|---|
| 4,568,134 | A | 2/1986 | DiMondi | |
| 4,820,169 | A * | 4/1989 | Weber et al. | 439/65 |
| 5,178,561 | A * | 1/1993 | Lindeberg et al. | 439/571 |
| 5,356,300 | A | 10/1994 | Costello et al. | |
| 5,620,329 | A * | 4/1997 | Kidd et al. | 439/248 |
| 5,769,669 | A * | 6/1998 | Hanks | 439/681 |
| 6,354,885 | B1 * | 3/2002 | Bradley et al. | 439/681 |
| 6,632,107 | B1 * | 10/2003 | Vanbesien | 439/680 |
| 6,830,469 | B1 * | 12/2004 | Doyle et al. | 439/247 |
| 6,945,810 | B1 * | 9/2005 | Morana et al. | 439/378 |
| 6,986,671 | B2 * | 1/2006 | Margulis et al. | 439/78 |
| 7,186,121 | B1 * | 3/2007 | Costello et al. | 439/79 |
| 7,326,092 | B2 * | 2/2008 | Fedder et al. | 439/681 |
| 7,621,754 | B2 * | 11/2009 | Costello | 439/65 |
| 2004/0087202 | A1 * | 5/2004 | Baccei et al. | 439/378 |
| 2005/0215107 | A1 * | 9/2005 | Castello et al. | 439/378 |
| 2005/0239317 | A1 * | 10/2005 | Margulis et al. | 439/378 |
| 2005/0282427 | A1 * | 12/2005 | Carullo | 439/378 |
| 2006/0079113 | A1 * | 4/2006 | Minich | 439/378 |
| 2006/0141847 | A1 * | 6/2006 | Ngo | 439/378 |

FOREIGN PATENT DOCUMENTS

| | | |
|---|---|---|
| DE | 201 17 303 | 2/2003 |
| EP | 1 085 618 | 3/2001 |
| WO | WO 89/02166 | 3/1989 |

OTHER PUBLICATIONS

International Search Report, International Application No. PCT/US2010/001617, International Filing Date Mar. 6, 2010.
High Speed Backplane Connectors (online), Dec. 31, 2008, pp. 137-162, XP002600835, TYCO Electronics (retrieved on Sep. 15, 2010).

* cited by examiner

*Primary Examiner* — Michael Zarroli
*Assistant Examiner* — Vladimir Imas

(57) ABSTRACT

A high speed electrical connector assembly is disclosed providing a first subassembly having connector assemblies attached to a daughtercard, and a second subassembly having connector assemblies attached to a backplane. A keying guide module is mounted to the daughtercard and a keying guide pin is mounted to the backplane. The alignment of the keying guide module and keying guide pin aligns the connector assemblies on the daughtercard and backplane.

28 Claims, 5 Drawing Sheets

ALIGNMENT ASSEMBLY FOR ELECTRICAL CONNECTORS

BACKGROUND OF THE DISCLOSURE

The present disclosure relates to high speed electrical connectors and more particularly to an apparatus for aligning high speed connectors and assemblies thereof.

Many different formats are available for high speed electrical connection. One such standard is VITA 46 (VME International Trade Association) which provides a VMEbus-based 7-row connector interface rated for switched fabrics at high speed I/O signaling rates up to 6.25 Gbps. This standard is designed to meet the applications typically required by defense and aerospace that requires a large number of densely populated, high-speed I/O pins. One of the challenges that VITA 46 poses is the alignment of the connectors/boards in such a highly dense population.

The assignee of the present application presently has a product line which addresses the connection aspect of this standard, which is marketed as the AMP MULTIGIG RT Connector. This assembly is comprised of a first connector for mounting to a daughtercard, and a second connector for mounting to a backplane. Round cross-sectional pins and sockets mounted to the boards align the assemblies.

SUMMARY

The present disclosure discloses an electrical connector assembly, comprising a first substrate carrying a first plurality of electrical connections, a second substrate carrying a second plurality of electrical connections, a keying guide module positioned on the first board and a keying guide pin positioned on the second board. The keying guide pin has plural planar and contiguous surfaces defining a keying profile, and the keying guide module has a complementary receiving opening for receiving in keyed receipt, the keying guide pin.

The present disclosure also discloses a keying assembly for keying an electrical connector assembly comprised of first and second electrical connections mounted on respective first and second substrates. The keying assembly comprises a keying guide module for positioning on the first board and a keying guide pin for positioning on the second board. The keying guide pin has plural planar and contiguous surfaces defining a keying profile, and the keying guide module has a complementary receiving opening for receiving in keyed receipt, the keying guide pin.

DETAILED DESCRIPTION OF THE DISCLOSURE

Figure 1:
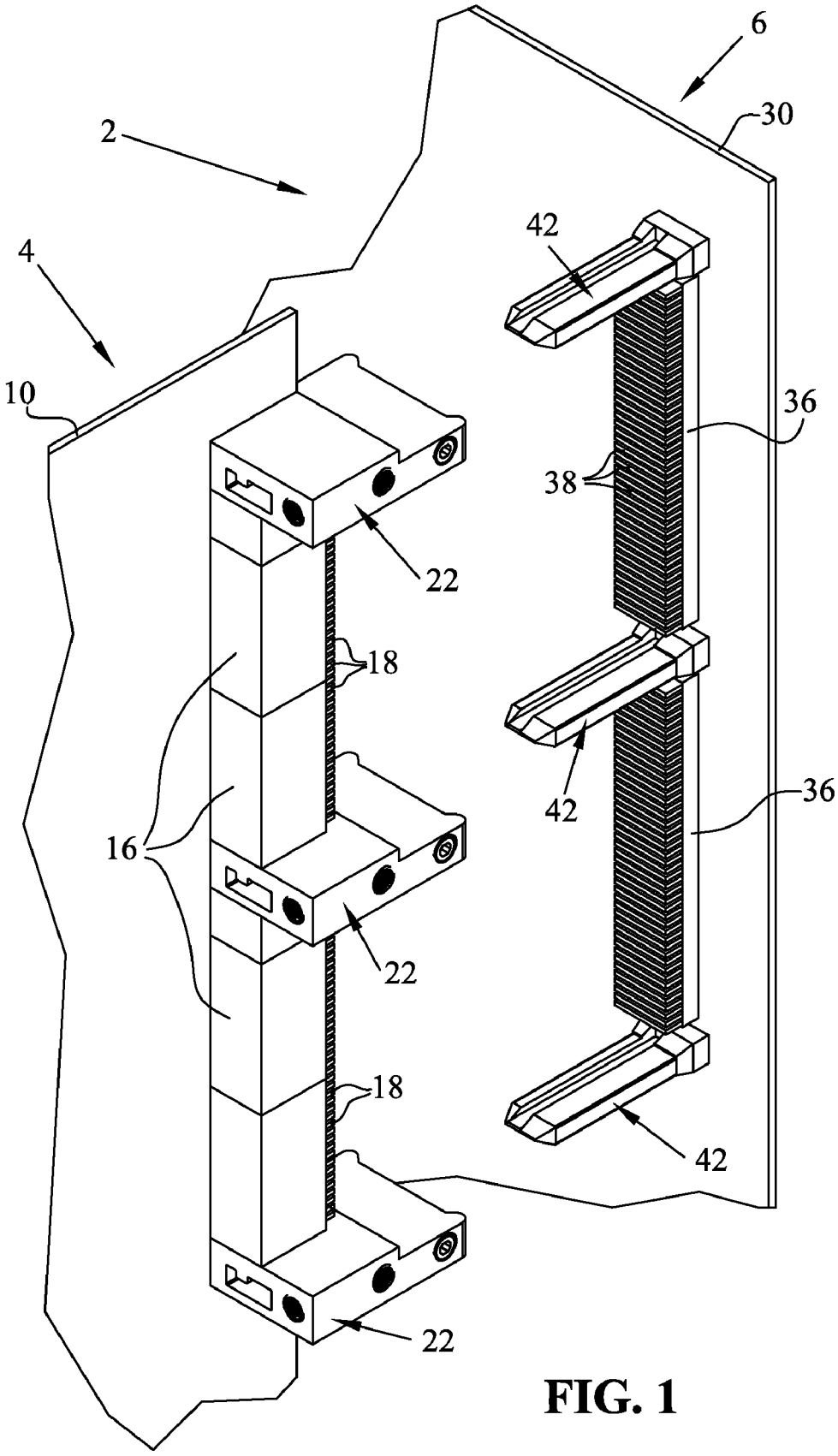
FIG. 1 shows a perspective view of two boards and plural associated connectors poised for interconnection, and aligned by a keying assembly.

With respect first to FIG. 1, an electrical connector assembly is shown at 2 comprised of a first connector subassembly

4 which is interconnectable to a second connector subassembly 6. Subassembly 4 is comprised of a board 10 in the form of a daughtercard having a plurality of connector modules 16 carrying electrical contacts 18. At the leading edge of the daughtercard, plural keying guide modules 22 are positioned for aligning connector subassembly 4 with connector subassembly 6 as described herein.

Connector subassembly 6 is comprised of a board 30 in the form of a back plane having a plurality of connector modules 36 having plural contacts 38 which are interconnectable to contacts 18 to interconnect the daughtercard 10 and backplane 30 as described herein. Subassembly 6 further comprises keying guide pins 42 located in an opposed manner to the keying guide modules 22 to align the connector subassembly 4 with connector subassembly as further described herein.

Figure 3:
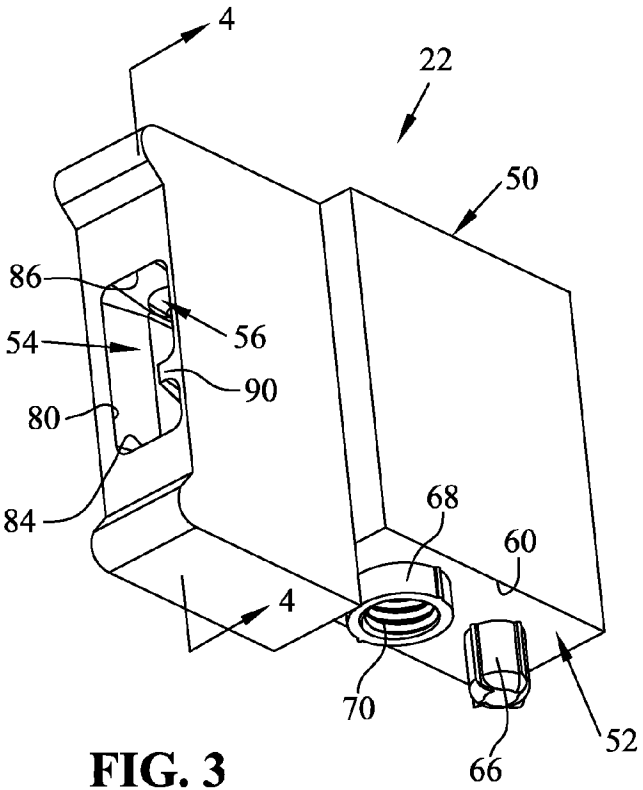
FIG. 3 shows a lower perspective view of the keying guide module shown in FIG. 2.

With respect now to FIGS. 2 and 3, the keying guide module 22 will be described in greater detail. Keying guide module 22 includes a module body 50 having a daughtercard receiving area 52, a keying guide pin receiving opening 54 and a grounding plunger contact 56 (FIG. 3). Daughtercard receiving area 52 is comprised of planer surface 60 and orthogonal surface 62. It should be appreciated that a daughtercard can be positioned in a planer relation to surface 60 and in an abutting relation with surface 62. Daughtercard receiving area 52 further comprises a locating peg 66 and a threaded boss at 68 having a plurality of internal threads at 70 (FIG. 3).

Figure 2:
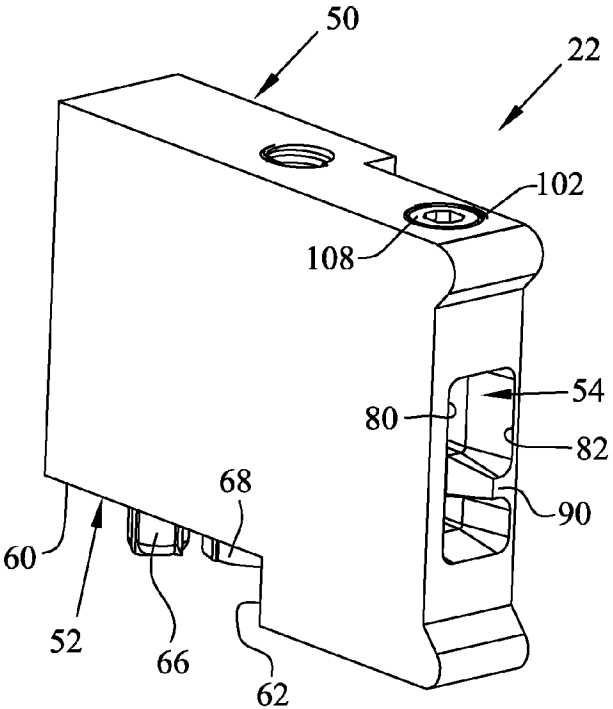
FIG. 2 shows an upper perspective view of the keying guide module shown in FIG. 1.
Figure 4:
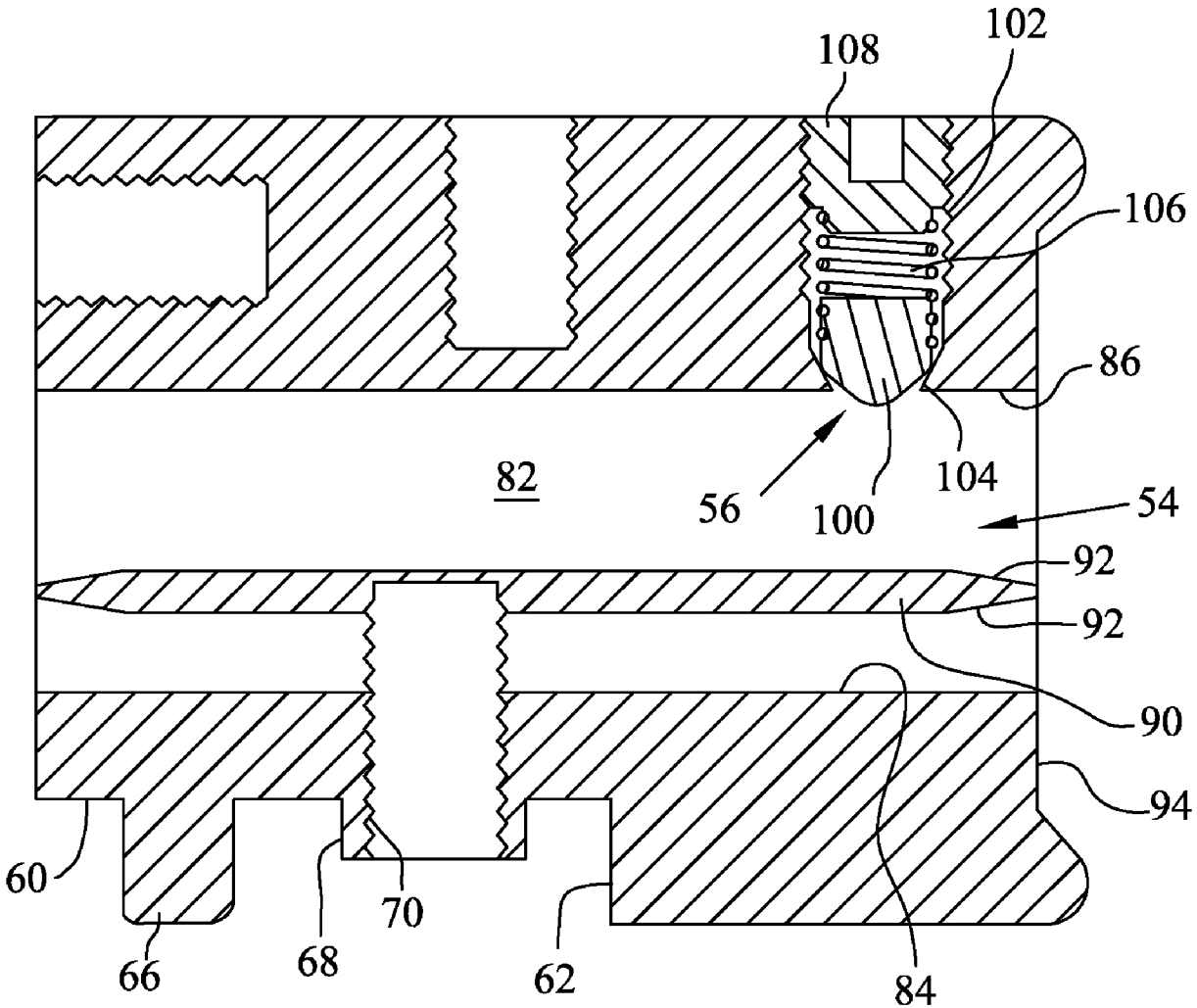
FIG. 4 is a cross-sectional view through lines 4-4 of FIG. 3.

As shown best in FIGS. 2-4, receiving opening 54 includes sidewalls 80 and 82 (FIG. 2) and end walls 84, 86 (FIG. 3). Surface 82 includes a keying tang 90 which extends inwardly from surface 82 to provide keying for the connector subassemblies 4, 6. Keying tang 90 includes lead-in surfaces 92 adjacent a front face 94. Although a single keying tang 90 is shown on surface 82, it should be appreciated that one or more of the keying tangs 90 could be positioned on any of the surfaces 80, 82, 84, 86.

As shown best in FIG. 4, grounding plunger contact 56 extends downwardly through surface 86 to a position where it is spring-loaded beyond surface 86. Grounding plunger contact 56 is comprised of a contact 100 positioned within opening 102 and spring-loaded against a lip 104 of the opening 102 by way of a spring 106. Spring 106 is held in position within opening 102 and within compression by way of a set screw 108 threadably engaged within threads of opening 102.

Figure 5:
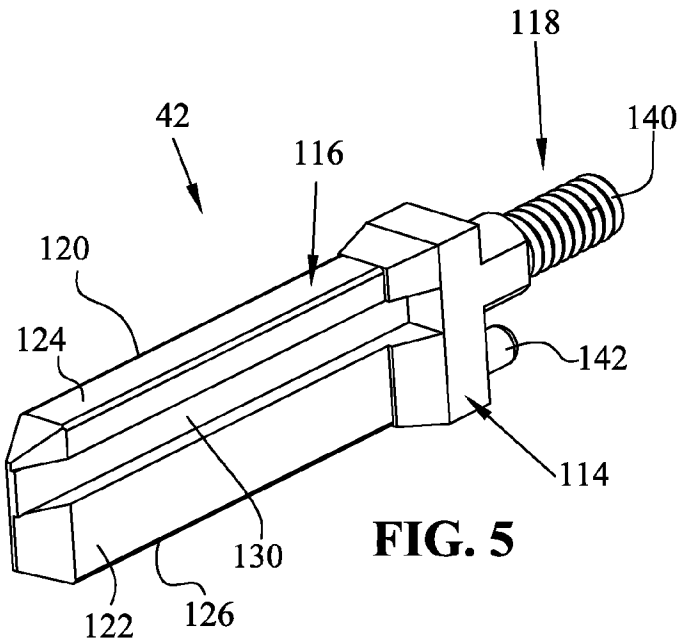
FIG. 5 shows a perspective view of the keying guide pin shown in FIG. 1.
Figure 6:
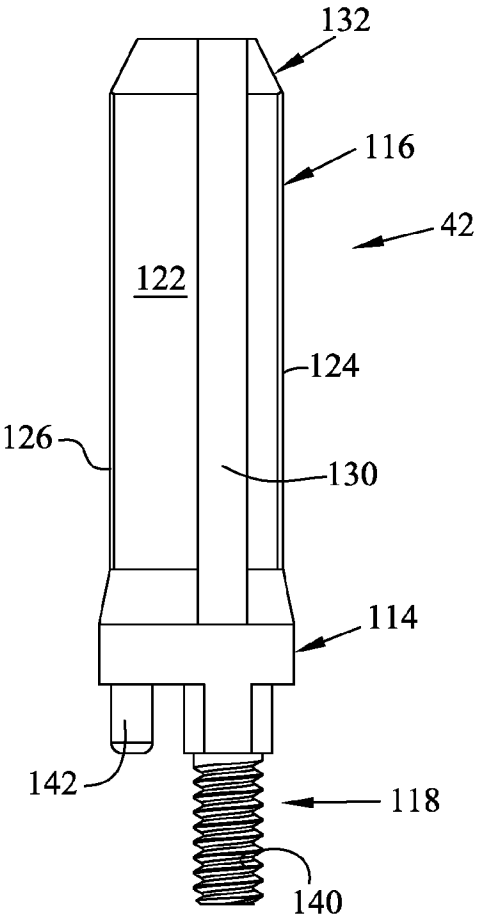
FIG. 6 shows a side plan view of the keying guide pin shown in FIG. 5.

With respect now to FIGS. 5 and 6, keying guide pin 42 includes a base portion 114 having a guide pin portion 116 and an attachment portion 118. Guide pin portion 116 is comprised of planar surfaces 120, 122, 124 and 126 which are contiguous to each other and which cooperate with corresponding surfaces 80, 82, 84, 86, respectively. Surface 122 is interrupted by a keying tang receiving slot 130 which cooperates with keying tang 90 on the keying guide module 22. Finally, guide pin portion 116 includes beveled or chamfered surfaces 132 (FIG. 6), which align and prevent the stubbing of, keying guide pin 42 with the receiving opening 54 of keying guide module 22 as described herein. Attachment section 118 includes a threaded stud 140 extending from base portion 114 and an alignment pin 142.

Figure 7:
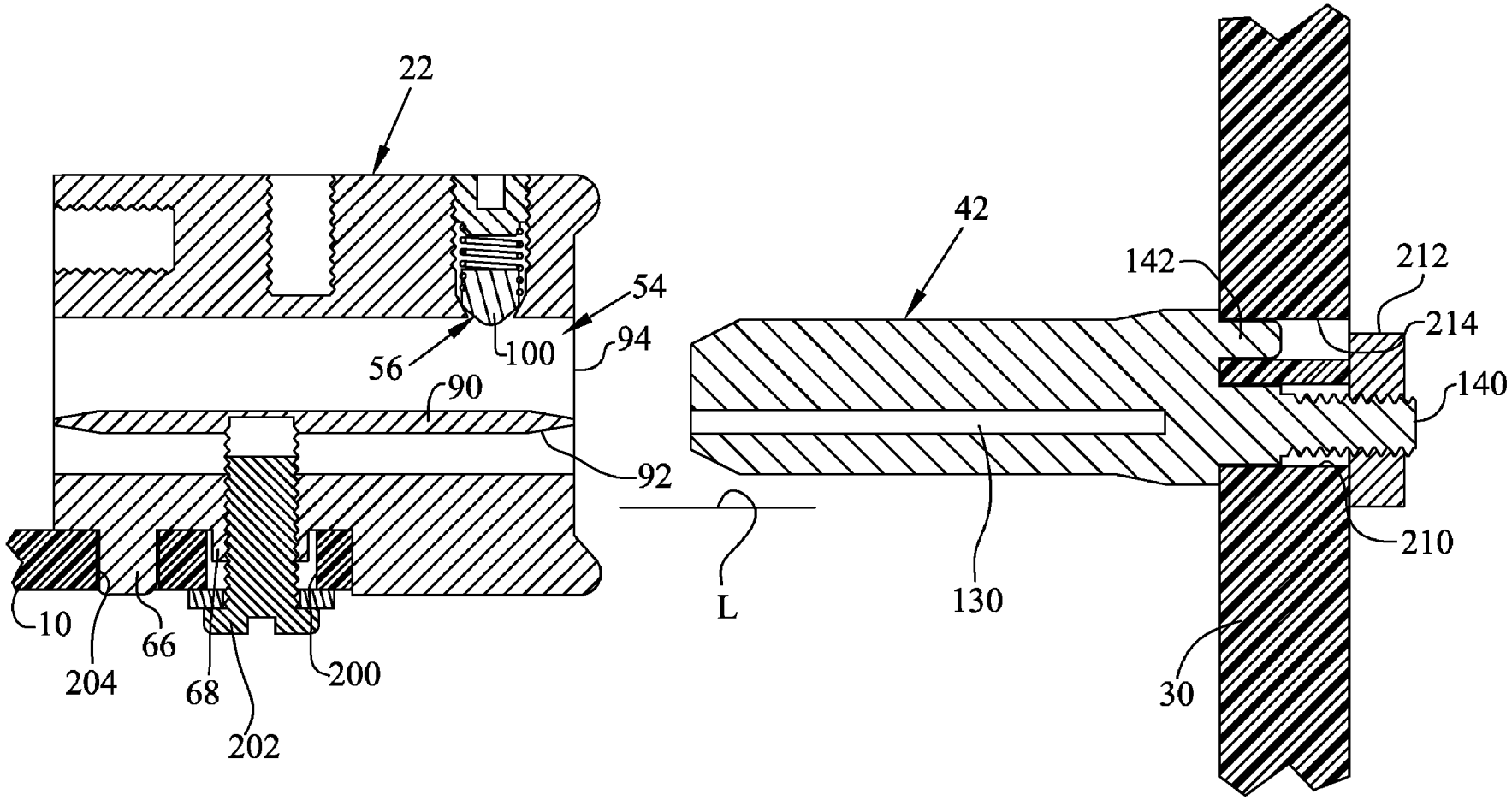
FIG. 7 shows a cross section of the assembly prior to mating.

With respect now to FIG. 7, the keying guide module 22 and keying guide pin 42 are shown attached to corresponding daughtercard 10 and backplane 30. Daughtercard 10 includes an aperture 200 receiving threaded insert 68 and receives a fastener 202 to pull the daughtercard and keying guide module together. Alignment peg 66 interferingly cooperates with opening 204 in daughtercard 10 to provide alignment therewith. Keying guide pin 42 is shown attached to backplane 30 with threaded stud 140 extending through an opening 210 with a fastener 212 attached to threaded stud 140 to retain the keying guide pin to the backplane 30. Alignment pin 142 is shown received in opening 214 to further align keying guide pin 42 with backplane 30.

As shown in FIG. 7, subassemblies 4 and 6 are movable and interconnectable along a longitudinal axis L whereby keying guide pin 42 is received in receiving opening 54 of keying guide module 42. As should be appreciated, receiving slot 130 cooperates with tang 90 to align the associated connector modules 16, 36 and contacts 18, 38 as described with reference to FIG. 1. It should also be appreciated that during the connection of keying guide pin 42 with keying guide module 22, contact 100 springloadably connects with keying guide pin 42 for grounding purposes. The grounding plunger contact assembly 56 is positioned adjacent to front face 94 such that contact is made between keying guide pin 42 and keying guide module 22, prior to any electrical connection being made between the associated contacts 18, 38. Naturally, the same is true during the disconnection of the subassemblies 4, 6, that is, the contacts 18, 38 disconnect before the disconnection of the ground provided between the grounding plunger contact assembly 56 and the keying guide pin 42.

As disclosed the keying guide module 22 and keying guide pin 42 are robust enough to align the daughtercard 10 and backplane 30. As disclosed, the keying guide pin has planar and contiguous surfaces 120, 122, 124, and 126 which define the keying profile. The keying guide module has complementary surfaces 80, 82, 84, 86 in receiving opening 54 for receiving the keying guide pin 42.

As shown, two surfaces 124, 126 are parallel with the plane of daughtercard 10, and surfaces 120, 122 are transverse to the daughtercard 10. As also shown, the distance between surfaces 124 and 126 is greater than the distance between surfaces 120, 122. This geometry is accommodated by forming the keying guide pin as a quadrilaterally shaped cross-section. As shown, one configuration for accommodating the geometry is to provide the keying guide pin as a rectangular cross-section.

As shown in FIG. 1, all keying guide pins 42 are of equal length. The length of the middle keying guide pin 42 may be shorter, in the event that the alignment of the entire assembly is misaligned by 180 degrees. This prevents the middle keying guide pin 42 from shorting the contacts 18.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An electrical connector assembly, comprising a first substrate carrying a first plurality of electrical connections, the first plurality of electrical connections being defined by a first housing and at least one contact; a second substrate carrying a second plurality of electrical connections, the second plurality of electrical connections being defined by a second housing and at least one contact; a keying guide module positioned on the first substrate and a keying guide pin positioned on the second substrate; the keying guide pin having plural planar surfaces which are contiguous with each other defining a keying profile, where at least some of the planar and contiguous surfaces of the keying guide pin are substantially perpendicular with each other, and the keying guide module having a complementary receiving opening comprising complementary planar and contiguous receiving opening surfaces for receiving in keyed receipt, the keying guide pin, where at least some of the planar and contiguous surfaces of the keying guide module are substantially perpendicular with each other, and complement the at least some of the planar and contiguous surfaces of the keying guide pin, the keying guide module being oriented transverse to the first substrate along a first axis and having a height, as measured from the first substrate, higher than a height of the first housing, with the complementary receiving opening being elongate along the first axis.

2. The electrical connector assembly of claim 1, wherein at least two of the planar surfaces of the keying guide pin are generally parallel to the first substrate, and at least two planar surfaces of the keying guide pin are generally transverse to the second substrate.

3. The electrical connector assembly of claim 2, wherein the distance between the at least two generally parallel planar surfaces of the keying guide pin is greater than the distance between the at least two generally perpendicular planar surfaces of the keying guide pin, and wherein the receiving opening the keying guide module has a position, as measured from the first substrate, higher than a height of the first housing.

4. The electrical connector assembly of claim 2, wherein the keying guide pin has a quadrilaterally shaped cross section.

5. The electrical connector assembly of claim 4, wherein the keying guide pin has a rectangular cross section.

6. The electrical connector assembly of claim 1, wherein the keying guide module mounts to an edge of the first substrate.

7. The electrical connector assembly of claim 6, wherein the first substrate is a daughter card.

8. The electrical connector assembly of claim 2, wherein either the keying guide module or the keying guide pin comprise a keying tang and the other of the keying guide module or the keying guide pin comprise a keying tang receiving slot for keying the keying guide module and the keying guide pin together.

9. The electrical connector assembly of claim 8, wherein the keying guide pin includes the keying guide slot.

10. The electrical connector assembly of claim 1, wherein either the keying guide module or the keying guide pin comprise a resilient contact to make grounding electrical contact with the other of the keying guide module or the keying guide pin.

11. The electrical connector assembly of claim 10, wherein the resilient contact is defined by a spring loaded discrete contact positioned to extend into the receiving opening in the keying guide module.

12. A keying assembly for keying an electrical connector assembly comprised of first and second electrical connections mounted on respective first and second substrates, the keying assembly comprising a keying guide module for positioning on the first substrate and a keying guide pin for positioning on the second substrate; the keying guide pin having plural planar surfaces contiguous with each other defining a keying profile, and the keying guide module having complementary surfaces in the receiving opening for receiving in keyed receipt, the keying guide pin wherein either the keying guide module or the keying guide pin comprise a keying tang and the other of the keying guide module or the keying guide pin comprise a keying tang receiving slot for keying the keying guide module and the keying guide pin together, the keying guide slot extending inwardly a first distance, where the first distance is approximately equal to one-half of a thickness of the keying guide pin.

13. The keying assembly of claim 12, wherein at least two of the planar surfaces of the keying guide pin are generally parallel to the second substrate, and at least two planar surfaces of the keying guide pin are generally perpendicular to the second substrate, and the distance between the at least two generally parallel planar surfaces of the keying guide pin is greater than the distance between the at least two generally perpendicular planar surfaces of the keying guide pin.

14. The keying assembly of claim 13, wherein the keying guide pin has a rectangular cross section, and the keying tang receiving slot is rectangular in configuration.

15. The keying assembly of claim 13, wherein the keying guide module mounts to an edge of the first substrate.

16. The keying assembly of claim 14, wherein the keying guide module is profiled to mount to a daughter card.

17. The keying assembly of claim 12, wherein the first plurality of electrical connections are defined by a first housing and at least one contact and the keying guide module is oriented transverse to the first substrate and has a height, as measured from the first substrate, higher than a height of the first housing.

18. The keying assembly of claim 16, wherein the keying guide pin includes the keying guide slot.

19. The keying assembly of claim 12, wherein either the keying guide module or the keying guide pin comprise a resilient contact to make grounding electrical contact with the other of the keying guide module or the keying guide pin.

20. The keying assembly of claim 18, wherein the resilient contact is defined by a spring loaded discrete contact positioned to extend into the receiving opening in the keying guide module.

21. The keying assembly of claim 1, wherein the keying guide pin has at least five planar surfaces which are contiguous with each other defining a keying profile.

22. The keying assembly of claim 21, wherein the at least five planar surfaces which are contiguous with each other defines the keying slot.

23. The keying assembly of claim 12, wherein the keying guide pin has at least five planar surfaces which are contiguous with each other defining a keying profile.

24. The keying assembly of claim 23, wherein the at least five planar surfaces which are contiguous with each other define the keying slot.

25. An electrical connector assembly, comprising:

a first substrate carrying a first plurality of electrical connections, the first plurality of electrical connections being defined by a first housing and at least one contact;

a second substrate carrying a second plurality of electrical connections, the second plurality of electrical connections being defined by a second housing and at least one contact;

a keying guide module positioned on the first substrate;

a keying guide pin positioned on the second substrate;

the keying guide pin having plural planar surfaces which are contiguous with each other defining a keying profile, the keying profile being generally rectangular in configuration, the keying guide pin further comprising a keying groove of rectangular configuration extending along the length of the pin and positioned on a long side of the rectangular configuration;

and the keying guide module having a complementary rectangular receiving opening comprising complementary planar and contiguous receiving opening surfaces for receiving in keyed receipt, the keying guide pin, the keying guide module further including a rectangular tongue profiled for keyed receipt in said keying groove.

26. The electrical connector assembly of claim 25, wherein at least two of the planar surfaces of the keying guide pin are generally parallel to the first substrate, and at least two planar surfaces of the keying guide pin are generally transverse to the second substrate.

27. The electrical connector assembly of claim 25, wherein the keying guide pin has a quadrilaterally shaped cross section.

28. The electrical connector assembly of claim 27, wherein the keying guide pin has a rectangular cross section.

* * * * *